US006013586A

United States Patent [19]

McGhee et al.

[11] Patent Number: 6,013,586

[45] Date of Patent: Jan. 11, 2000

[54] TENT MATERIAL PRODUCT AND METHOD OF MAKING TENT MATERIAL PRODUCT

[75] Inventors: James M. McGhee; Tetsuya O'Hara, both of Woodstock, Conn.

[73] Assignee: Dimension Polyant Sailcloth, Inc., Putnam, Conn.

[21] Appl. No.: 08/947,673

[22] Filed: Oct. 9, 1997

[51] Int. Cl.[7] ..... B32B 27/34

[52] U.S. Cl. ..... 442/131; 442/62; 442/164; 442/183; 442/287

[58] Field of Search ..... 442/62, 131, 164, 442/183, 287

[56] References Cited

U.S. PATENT DOCUMENTS

| | | | |
|---|---|---|---|
| 4,510,282 | 4/1985 | Goll | 524/337 |
| 4,542,067 | 9/1985 | Yamamoto et al. | 428/237 |
| 4,679,519 | 7/1987 | Linville | 114/103 |
| 4,746,565 | 5/1988 | Bafford et al. | 428/251 |
| 4,758,465 | 7/1988 | McKinney et al. | 428/252 |
| 5,198,287 | 3/1993 | Samson et al. | 428/248 |
| 5,458,956 | 10/1995 | Shi et al. | 428/229 |
| 5,569,524 | 10/1996 | Akatsu et al. | 428/215 |

*Primary Examiner*—Helen L. Pezzuto
*Attorney, Agent, or Firm*—St. Onge Steward Johnston & Reens LLC

[57] ABSTRACT

Tent material is provided having a resin coating. High UV resistance may be provided using resin coating with titanium dioxide. Colored tent material is provided using a resin coating with a coloring ingredient. Colored tent material having high UV resistance is provided using a resin coating with titanium and a coloring ingredient. Method is provided including laminating coating and fabric. Tent material retains its tensile and tear strength over prolonged exposure to outdoor conditions and after repeated laundering. Tent material is provided having brilliant colors and that can utilize colorless, white or multi-colored fabrics. Tent material provided retains its color and does not peel or flake over prolonged exposure to outdoor conditions.

13 Claims, 4 Drawing Sheets

TENT MATERIAL PRODUCT AND METHOD OF MAKING TENT MATERIAL PRODUCT

FIELD OF THE INVENTION

The invention relates to tent material and method for making tent material, and more particularly tent material with coatings providing high ultra-violet (UV) radiation resistance.

BACKGROUND OF THE INVENTION

Urethane-coated nylon is conventionally used in the United States as tent material. Typically, conventional fabric for tent material is coated with a urethane resin coating for waterproofing. Colored tent material can be provided by dying urethane coated nylon fabric tent material using conventional dyes. Conventional dyes for coloring are solutions. Dyes therefore tend to be translucent and soak into or impregnate fabric during dying rather than coating the surface of fabric with an opaque coating. Thus, brightness of colors in which the dyed tent material may be offered is limited and dyed tent material tends to be dull. Further, dying tent material does not mask the color of fabric base material. Therefore, fabric used in conventional tent material must be of uniform color and lot, and the color of fabric used must be similar to desired color of tent material. For example, if orange tent material is desired, then black fabric typically cannot be used. In addition to the translucency of dyed tent material, color of conventional tent material tends to fade over time exposure to outdoor conditions. Polyester fabrics have also been used in conventional tent material.

Sunlight, the source of most UV radiation affecting tent materials, causes the urethane resin coatings of conventional materials to break down and lose their durability. This breakdown results in color fading, peeling and flaking of the coating. Sunlight also causes reduced tear strength in conventional tent material resulting in reduced waterproofness. To ensure sufficient durability of conventional tent material, thicker fabrics (i.e., higher denier) must be used which have the disadvantage of increasing weight and cost of the tent and tent material.

Conventional tent materials are generally not recyclable because they are made of dissimilar fabrics and resin coatings. Tent material that is made of the same fabric and coating would enhance recyclability of tent material.

Silicone coated fabric is conventionally used as tent material in Europe. A disadvantage of using silicone coatings is that they fail U.S. flame retardancy regulations for tents. Another disadvantage of silicone coated tent material is that seams and tears in silicone coated tent material cannot be taped. Thus, tents and other articles made of conventional silicone coated material may have leaky seams and may be more difficult to repair.

U.S. Pat. No. 4,542,067 to Yamamoto et al. ('067) discloses a tent material fabric impregnated with a silicone resin-containing fibrous potassium titanate varnish solution. Fibrous potassium titanate is compounded into the silicone resin varnish to impart flameproofing and reinforcing action to the fabric material. Yamamoto '067 neither discloses a coating which does not impregnate fibers, nor pigment for coloring for such a coating, nor lamination of such coating to a fabric substrate, nor application of adhesive to such a coating or the fabric.

Further, conventional tent material does not typically withstand repeated laundering or repeated exposure to sun and rain. Thus, laundering or exposure to sun and rain may cause conventional tent material to prematurely fade, peel, rip and leak.

What is desired, therefore, is a tent material having high UV-resistance, minimum reduction in tear strength over time exposure to outdoor conditions and repeated laundering, that can be repaired by taping seams and tears, and that passes U.S. flame retardancy requirements. Also desired is tent material that can be provided in brilliant colors, that maintains its color after extended periods of exposure to outdoor conditions and UV radiation. Additionally, tent material that is recyclable and that can utilize fabric of any color and made of recycled plastic is desired.

SUMMARY OF THE INVENTION

Accordingly, it is an object of the invention to provide tent material that has high UV resistance over prolonged exposure to outdoor conditions.

Another object of the invention is to provide tent material that maintains tensile and tear strength over prolonged exposure to outdoor conditions or repeated laundering.

Yet another object of the invention is to provide a tent material that retains its color over prolonged exposure to outdoor conditions.

Yet a further object of the invention is to provide a tent material that can be provided in brilliant colors.

Still another object of the invention is to provide a tent material in a variety of brilliant colors independent of the color of the fabric base material or whether the fabric is made of recycled plastic.

Still a further object of the present invention is to provide a tent material of the above character that has a polyester resin coating.

Still yet another object of the present invention is to provide a tent material of the above character that has a fabric laminated with a polyester resin coating.

Yet still a further object of the invention is to provide a tent material of the above character that does not peel or flake over prolonged exposure to sunlight, rain or repeated laundering.

These and other objects of the invention are achieved by providing tent material having a fabric coated with a polyester UV resistant coating. UV resistant coating consists of a polyester resin coating laminated to fabric using a polyester urethane adhesive. UV resistant coating may or may not contain titanium dioxide. The polyester resin may contain a coloring ingredient or a coloring ingredient and titanium dioxide, or only titanium dioxide. When titanium dioxide is added to the polyester resin UV resistance is improved. Coloring ingredient can be pigment for providing brilliant colors. Fabric can be nylon or polyester fabric, can be woven and can include polyester strands.

According to a further aspect of the present invention, a method for providing tent material is disclosed that includes laminating coating and fabric. Additionally, the inventive method can include an adhesive application step.

The invention and its particular features and advantages will become more apparent from the following detailed description considered with reference to the accompanying drawings.

DETAILED DESCRIPTION OF THE INVENTION

Figure 1:
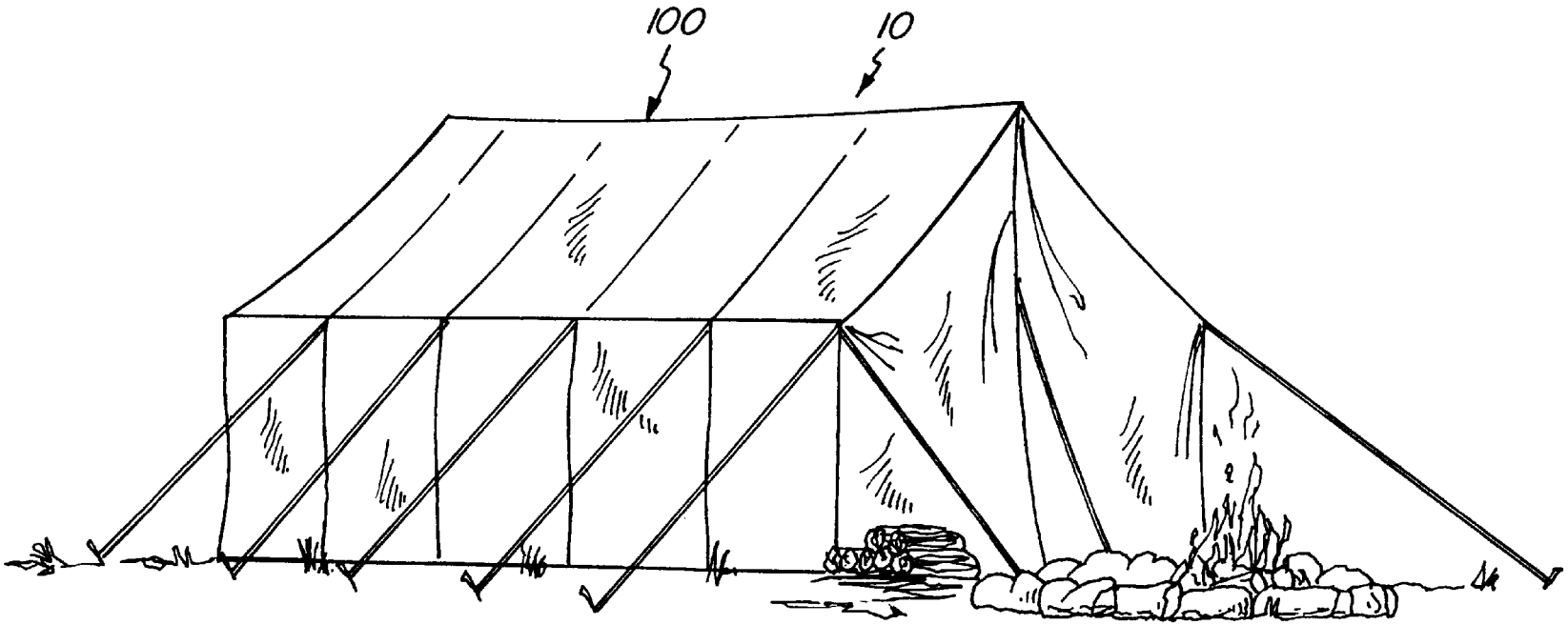
FIG. 1 is an isometric view of a schematic representation of a tent in accordance with the invention.
Figure 2:
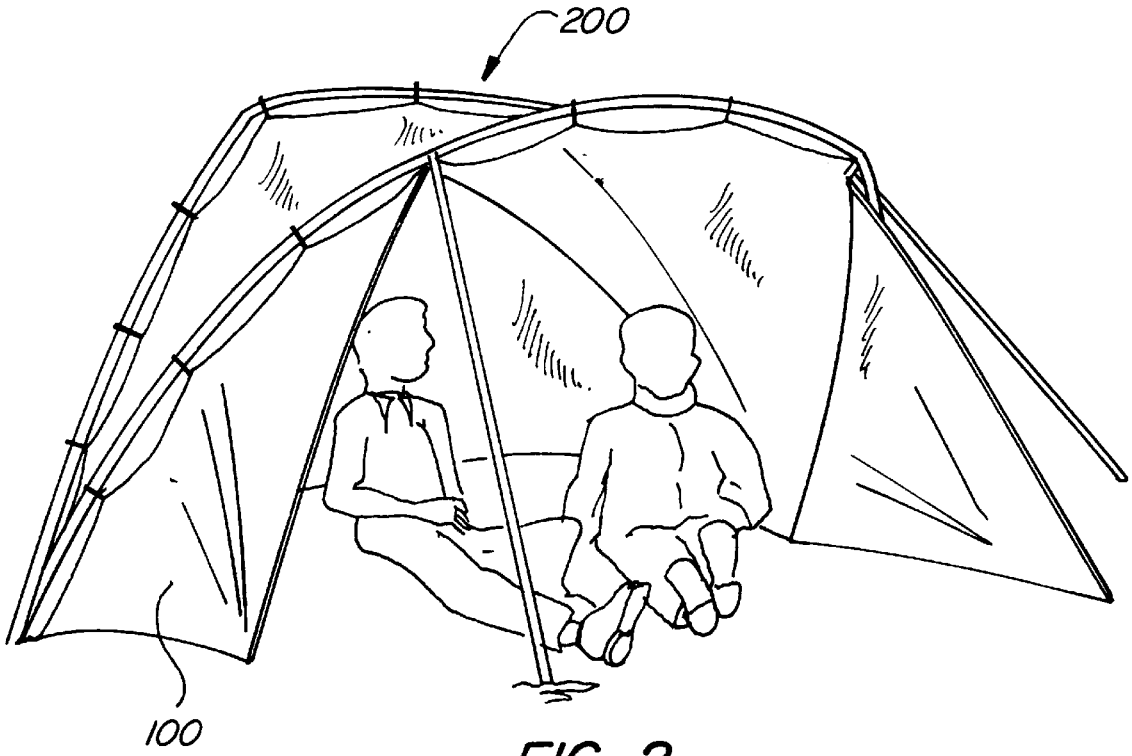
FIG. 2 is an isometric view of a schematic representation of a windscreen in accordance with another embodiment of the invention.
Figure 3:
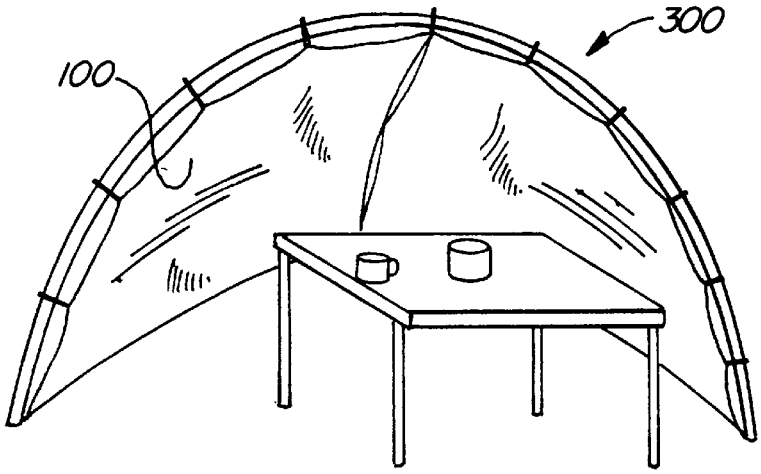
FIG. 3 is an isometric view of a schematic representation of a sunscreen in accordance with another embodiment of the invention.

FIG. 1 shows a tent 10 made with the tent material 100 in accordance with the present invention. By "tent material" is meant material for use in manufacturing tents, tarps, awnings, windscreens, sunscreens and like articles where light weight and water repelling characteristics are desired. FIGS. 2 and 3 show a windscreen 200 and a sunscreen 300 also made of material 100 of the invention.

Articles 10, 200 and 300 made of tent material 100 are fabricated using conventional tent construction techniques. Articles 10, 200 and 300 made of tent material 100 can replace conventional tents made of conventional materials, such as silicone coated polyester or nylon fabric, polyurethane coated polyester or nylon, or other fabric, such as woven polyester (PET), polyethylenenaphthalate (PEN) , or polyethylenenaphthalatebibenzoate (PENBB) fabrics.

Figure 4:
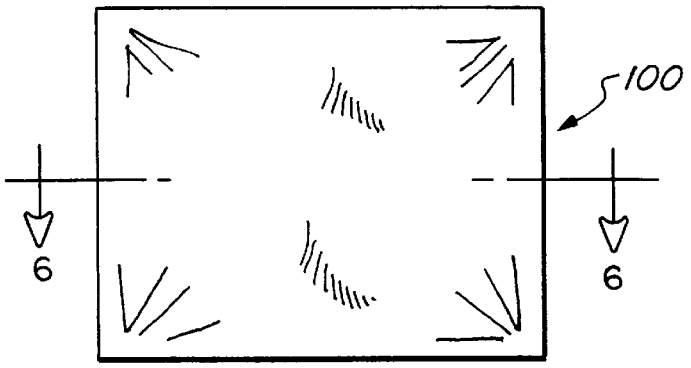
FIG. 4 is a plan view of tent material.
Figure 5:
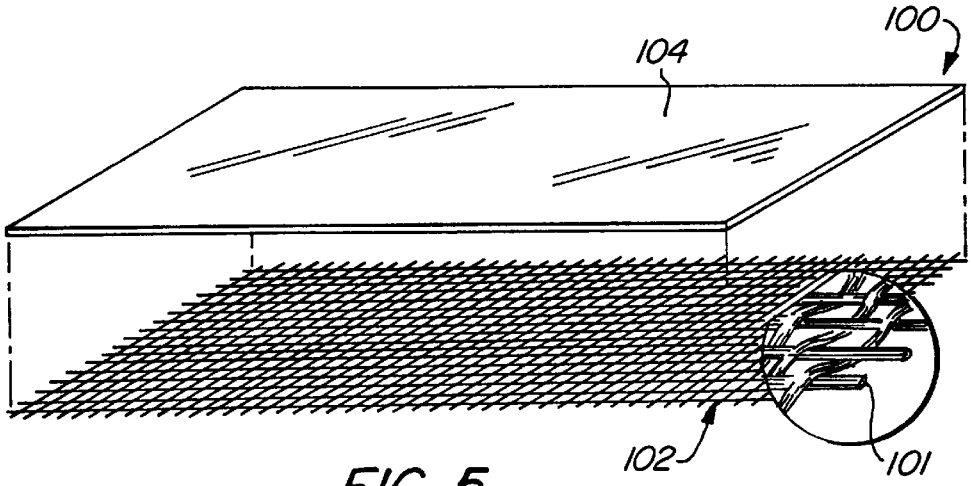
FIG. 5 is an exploded isometric sectional view of tent material of FIG. 4 at section 5—5 in accordance with the invention magnified to show coating on fabric and a magnified portion of one type of weave of fabric.
Figure 6:
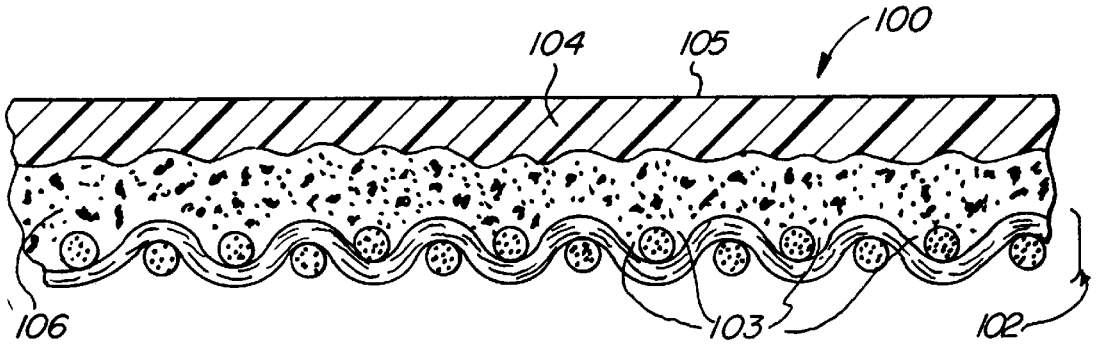
FIG. 6 is a magnified side view of the tent material of the invention magnified to show coating, adhesive, and fabric in accordance with the invention.

FIG. 4 shows tent material 100 in more detail. FIG. 5 shows tent material 100 including fabric 102 and coating 104. FIG. 6 further shows tent material 100 including fabric 102, adhesive 106 and coating 104. Fabric 102, adhesive 106 and coating 104 are coextensive with one another. Fabric 102 is preferably woven, as shown in FIG. 5, but can be knitted or scrim. Most preferably fabric 102 can be polyester fabric having a special weaving that stops rips or tears from spreading in the fabric, such as that sold under the trademark RIPSTOP™. Coating 104 is applied to a side of fabric 102 filling only interstices 103 of fabric 102, and does not impregnate or soak through fibers 101 of fabric 102. Coating 104 has a smooth surface 105 as shown in FIG. 5 and is typically applied to one side of fabric 102.

Figure 7:
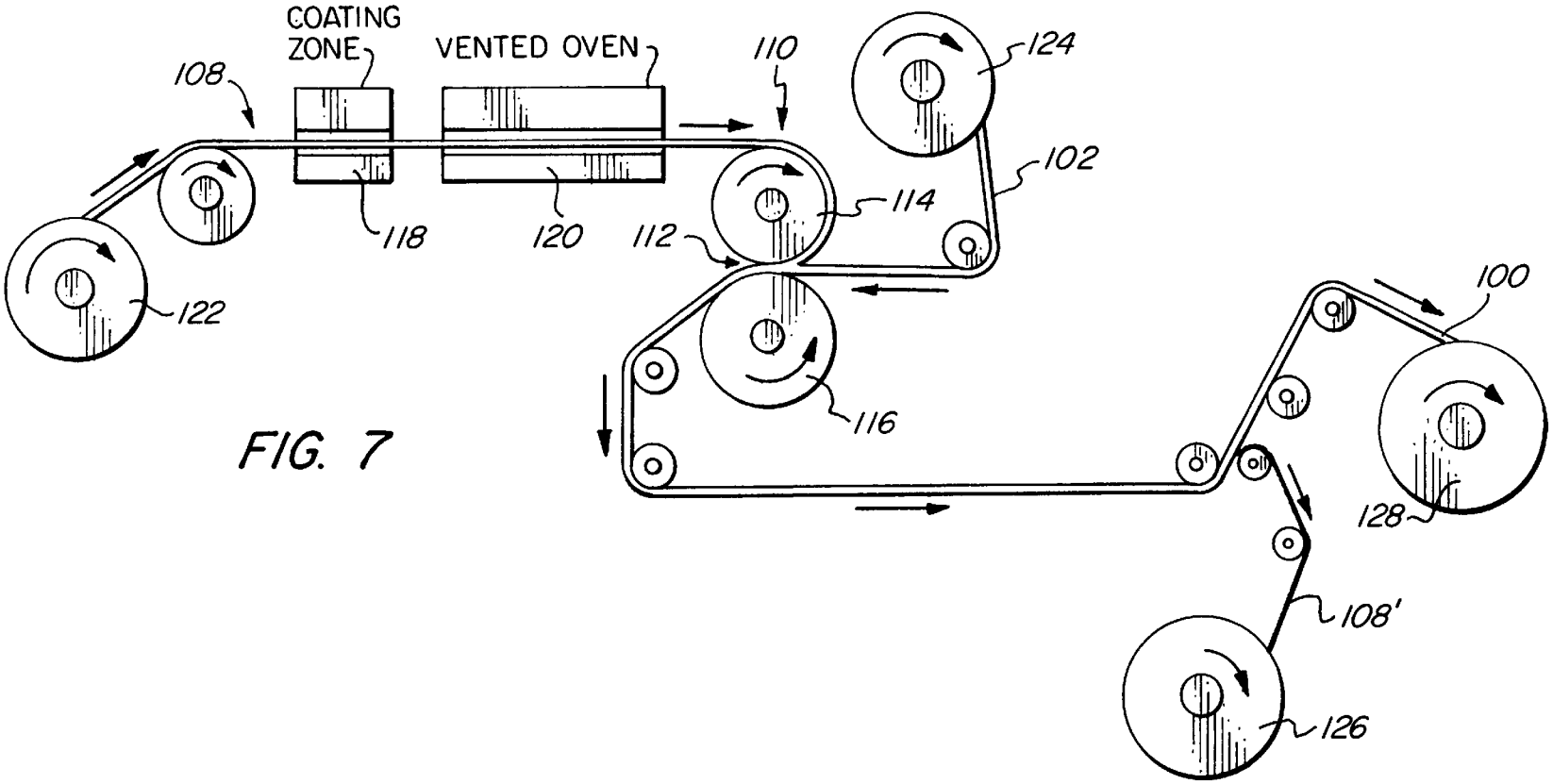
FIG. 7 is a schematic representation of an apparatus and process for the continuous manufacture of tent material in accordance with the invention.

Tent material 100 is preferably formed by laminating using the apparatus shown in FIG. 7 wherein fabric 102, adhesive 106 and coating 104 are laminated by applying heat and pressure across the entire area of the laminate. Coating 104 of tent material 100 has a smooth surface 105 after lamination.

The temperature applied during lamination is such that adhesive 106 flows into interstices 103 of fabric 102, but does not flow through or between fibers 101 of fabric 102, thereby adhering coating 104 and fabric 102. A preferred temperature for lamination roller 114 of the apparatus of FIG. 7 is in the range of 100° C. to 200° C. depending upon the particular adhesive used. It is also understood that coating 104 does not flow through fabric 102.

Fabric 102 is typically a colorless polyester or nylon fabric and is preferably polyester. Fabric 102 is preferably of a thin lightweight construction, such as 40 or 70 denier in thickness.

Coating 104 is preferably made of polyester or other aliphatic hydrocarbon resin. Coating 104 can include an additive for reducing transmission of UV radiation. Preferably UV resistant resin coating 104 includes titanium dioxide.

Coating 104 can also include a coloring ingredient for coloring tent material 100. Tent material 100 colored using a coloring ingredient as in the present invention is colored only where coating 104 is applied. For example, using the process shown in FIG. 7 only one side of tent material 100 is colored. Coloring ingredient is preferably a pigment for coloring tent material 100. By "pigment" is meant a particulate coloring ingredient dispersed in a resin such that an opaque or nontranslucent color results having masking characteristics. It is understood however that coloring ingredient can include a colored resin concentrate. Pigment is preferably an automotive pigment for providing brilliant colors having excellent stability against UV radiation.

Color of fabric 102 using coloring ingredient to color tent material 100, and most specifically using a pigment, is immaterial. It is understood therefore, that white, multicolored, multi-lot, clear or otherwise colorless fabric 102 may be used to make tent material 100 having color different from color of fabric 102 using coloring ingredient of the invention. Tent material 100 of the invention using pigment as coloring ingredient exhibits no color loss after over 300 hours exposure in a QUV Accelerating Weathering Tester, The Q-Panel Company, Cleveland, Ohio, compared to conventional urethane coated material that lose their color under the same conditions.

Tent material 100 is made by either direct or transfer coating fabric 102 with coating 104 having UV stabilizer and/or pigment using the apparatus shown in FIG. 7. FIG. 7 is a schematic representation of a process and apparatus for the continuous fabrication of tent material 100 in accordance with the invention. The particular embodiment shown is that involving the lamination of coating 104 and fabric 102. It is further understood that coating 104 may be applied to both sides of fabric 102 to make tent material 100 having two coated sides. Tent material 100 may be laminated on both sides by changing the configuration of the apparatus shown in FIG. 7 or by laminating tent material 100 and a second layer of coating 104 using a second layer of adhesive 106. It is further understood that polyester strands can be laminated with the coating and fabric to produce a further embodiment of the tent material that is reinforced.

In accordance with the particular embodiment for making tent material 100 shown in FIG. 7, release liner 108 is dispensed from a roll of release liner 122 and passed through a coating zone including a coater 118 for direct or indirect coating of coating 104 onto release liner 108, and for reverse roll or doctor blade coating adhesive 106 onto coating 104 on release liner 108. Release liner 108 with coating 104 and adhesive 106 is passed through a vented oven 120 for removing solvent from adhesive 106.

Adhesive 106 is preferably a heat activated polyester urethane adhesive sold by Morton International Incorporated under the trademark ADCOTE 122™. The resin coating, for example, can preferably contain approximately 5% (by volume) titanium dioxide, 90% polyester resin, and 5% pigment, depending upon color desired.

Lamination of the layers occurs by passing solvent-free adhesive on resin coated release liner layer 110 and fabric 102 fed from a roller of fabric 124 into a high pressure nip 112 and applying pressure thereto between heated lamination roller 114 and backup roller 116. Release liner 108' is removed from the laminated layers 117 and wound onto a take-up roller 126. Lamination in this way produces tent material 100 that has a smooth resin coating surface 105 and forces adhesive 106 in interstices 103 of fabric 102, as shown in FIG. 6.

Table 1 shows minimum reduction of tear strength of tent material of the present invention as compared to conventional tent material over prolonged exposure to UV accelerated conditions assimilating outdoor conditions. Table 1 shows that tent material 100 retains 95% of its tear strength after 300 hours of exposure while conventional materials retain only between 33 to 65% of their original tear strength under the same test conditions. Table 1 shows UV Accelerating Test Results for conventional polyurethane coated polyester fabric and polyurethane coated nylon fabric, and two embodiments of tent material 100 of the invention, polyester resin coating 104 on 40 denier fabric 102, and polyester resin coating 104 on 70 denier nylon fabric 102.

TABLE 1

UV Accelerating Test
Testing Machine: QUV Accelerated Weathering Tester, The Q-Panel Company, Cleveland, OH
Test Results: Tear strength by Single Tongue Method, lbs.

| Tent Material | Original | After 100 hours | After 200 hours | After 300 hours |
|---|---|---|---|---|
| Polyester resin coating/ 40 denier polyester fabric base material | 3.0 (100%) | 3.0 (100%) | 3.5 (116%) | 3.3 (110%) |
| Polyester resin coating/ 70 denier Nylon fabric base material | 4.7 (100%) | 4.0 (85%) | 4.3 (91%) | 4.5 (95%) |
| Polyurethane resin coating/40 denier polyester fabric base material | 5.0 (100%) | 2.3 (46%) | 2.0 (40%) | 1.7 (34%) |
| Silicone coating/ 70 denier nylon fabric base material | 15.0 (100%) | 10.0 (66%) | 7.2 (48%) | 5.0 (33%) |
| Polyurethane resin coating/70 denier nylon fabric base material | 2.3 (100%) | 1.5 (65%) | 1.0 (43%) | 1.5 (65%) |

Table 2 shows minimum reduction of waterproof characteristics of tent material 100 of the invention as compared to conventional tent material after repeated laundering. Table 2 shows excellent durability of tent material 100 as a measure of waterproofness as compared to conventional tent material made of silicone coated and urethane resin coated nylon fabric.

TABLE 2

Durability
Test Result: PSI measured on Mullen Tester after 5 Launderings.

| Tent Material | Before (psi) | After (psi) |
|---|---|---|
| Polyester resin/Polyester or nylon fabric | 140 | 120 |
| Urethane resin/Polyester or nylon fabric | 95 | 32 |
| Silicone resin/Nylon fabric | 75 | 16 |

Although the invention has been described with reference to a particular arrangement of parts, features and the like, these are not intended to exhaust all possible arrangements or features, and indeed many other modifications and variations will be ascertainable to those of skill in the art.

What is claimed is:

1. A tent material having high UV-resistance, minimum reduction in tear strength over time exposure to outdoor conditions and repeated laundering, that can be repaired by taping seams and tears, and that passes U.S. flame retardancy requirements, comprising a fabric comprised of strands of a material selected from the group consisting of polyester and nylon, a polyester coating including titanium dioxide and an adhesive layer bonding said coating to said fabric.

2. A tent material as in claim 1 wherein said fabric is colorless.

3. A tent material as in claim 1 wherein said fabric is polyester.

4. A tent material as in claim 1 wherein said fabric is woven.

5. A tent material as in claim 1, further comprising a pigment in said coating as a coloring ingredient.

6. A tent material as in claim 1 wherein said coating is adhered to the tent material with polyester urethane adhesive.

7. A tent material as in claim 6 wherein said tent material is woven.

8. A tent material as in claim 7 wherein the coloring ingredient comprises a UV stable automotive pigment.

9. A tent material as in claim 8 wherein said coating includes polyester resin.

10. A tent material as in claim 8 wherein said tent material comprises polyester strands.

11. A tent material as in claim 8 wherein said coating is adhered to the tent material with polyester urethane adhesive.

12. A tent material as in claim 10 wherein said tent material is woven.

13. A tent material as in claim 7 wherein said fabric is comprised of polyester strands.

* * * * *